US009699553B2

(12) United States Patent
Oishi et al.

(10) Patent No.: US 9,699,553 B2
(45) Date of Patent: Jul. 4, 2017

(54) CUSTOMIZING AUDIO REPRODUCTION DEVICES

(71) Applicant: Skullcandy, Inc., Park City, UT (US)

(72) Inventors: Tetsuro Oishi, Park City, UT (US); Rex Price, Park City, UT (US); Samuel Paschel, Park City, UT (US); Matthew Windt, Park City, UT (US); Thomas Bishop, Park City, UT (US)

(73) Assignee: Skullcandy, Inc., Park City, UT (US)

( * ) Notice: Subject to any disclaimer, the term of this patent is extended or adjusted under 35 U.S.C. 154(b) by 81 days.

(21) Appl. No.: 14/209,692

(22) Filed: Mar. 13, 2014

(65) Prior Publication Data

US 2014/0270254 A1 Sep. 18, 2014

Related U.S. Application Data

(60) Provisional application No. 61/794,718, filed on Mar. 15, 2013.

(51) Int. Cl.
*H04R 3/04* (2006.01)
*H04R 5/04* (2006.01)
(Continued)

(52) U.S. Cl.
CPC ..... *H04R 3/04* (2013.01); *H04R 1/1041* (2013.01); *H04R 5/033* (2013.01); *H04R 5/04* (2013.01); *H04R 1/1083* (2013.01); *H04R 2201/107* (2013.01); *H04R 2420/07* (2013.01); *H04R 2460/01* (2013.01); *H04R 2460/07* (2013.01)

(58) Field of Classification Search
CPC ..... H04R 3/04; H04R 29/00; H04R 2410/05; H04R 2430/01; H04S 7/307; G10K 11/178; G10K 11/1782; G10K 11/1784; G10K 11/1786; H03G 9/02; H03G 9/025;
(Continued)

(56) References Cited

U.S. PATENT DOCUMENTS 8,675,880 B2 * 3/2014 De Bruijn ..... H04R 1/403 381/17
8,823,484 B2 * 9/2014 Kennedy ..... H04M 1/72519 340/3.1
(Continued)

FOREIGN PATENT DOCUMENTS

WO WO 2011/109790 9/2011

OTHER PUBLICATIONS

Eurpoean Search Report from European Patent Application No. 14160136.9-1910 dated Jun. 6, 2014.

*Primary Examiner* — Davetta W Goins
*Assistant Examiner* — Daniel Sellers
(74) *Attorney, Agent, or Firm* — TraskBritt

(57) ABSTRACT

The disclosure includes a system and method for sonically customizing an audio reproduction device. The system includes a processor and a memory storing instructions that when executed cause the system to determine an application environment associated with an audio reproduction device associated with a user; determine one or more sound profiles based on the application environment; provide the one or more sound profiles to the user; receive a selection of a first sound profile from the one or more sound profiles; and generate tuning data based on the first sound profile, the tuning data configured to sonically customize the audio reproduction device.

20 Claims, 6 Drawing Sheets

(51) Int. Cl.
*H04R 5/033* (2006.01)
*H04R 1/10* (2006.01)

(58) Field of Classification Search
CPC ..... H03G 9/14; H03G 5/165; H03G 5/18; H03G 5/22
USPC ... 381/98, 101–104, 107, 56, 57, 94.1, 94.2, 381/94.3, 94.7
See application file for complete search history.

(56) References Cited

U.S. PATENT DOCUMENTS

| | | | | |
|---|---|---|---|---|
| 9,055,621 | B2 * | 6/2015 | Shrubsole | H05B 37/02 |
| 2005/0251273 | A1 * | 11/2005 | Bychowsky | H04H 20/31 700/94 |
| 2008/0153537 | A1 * | 6/2008 | Khawand | H03G 3/32 455/550.1 |
| 2009/0047993 | A1 * | 2/2009 | Vasa | G11B 27/105 455/556.1 |
| 2010/0040245 | A1 * | 2/2010 | Buil | H04M 1/05 381/107 |
| 2011/0002471 | A1 | 1/2011 | Wihardja et al. | |
| 2013/0128119 | A1 * | 5/2013 | Madathodiyil | H04N 21/4852 348/563 |

* cited by examiner

CUSTOMIZING AUDIO REPRODUCTION DEVICES

CROSS-REFERENCE TO RELATED APPLICATION

This application claims priority under 35 USC §119(e) to U.S. Application No. 61/794,718, entitled "Customizing Audio Reproduction Devices." filed Mar. 15, 2013, the entirety of which is herein incorporated by reference.

BACKGROUND

The specification relates to audio reproduction devices. In particular, the specification relates to interacting with audio reproduction devices.

Users can listen to music using a music player and a headset. However, various factors may affect a user's listening experience provided by the headset. For example, surrounding noise in the environment may degrade a user's listening experience.

SUMMARY

According to one innovative aspect of the subject matter described in this disclosure, a system for sonically customizing an audio reproduction device includes a processor and a memory storing instructions that, when executed, cause the system to: determine an application environment associated with an audio reproduction device associated with a user; determine one or more sound profiles based on the application environment; provide the one or more sound profiles to the user; receive a selection of a first sound profile from the one or more sound profiles; and generate tuning data based on the first sound profile, the tuning data configured to sonically customize the audio reproduction device.

According to another innovative aspect of the subject matter described in this disclosure, a system for sonically customizing an audio reproduction device includes a processor and a memory storing instructions that, when executed, cause the system to: monitor audio content played on an audio reproduction device associated with a user; determine a genre associated with the audio content; determine an application environment associated with the audio reproduction device, the application environment indicating an activity status associated with the user; determine one or more deteriorating factors that deteriorate a sound quality of the audio reproduction device; estimate a sound leakage caused by the one or more deteriorating factors; determine a sound profile based on the application environment and the genre associated with the audio content, the sound profile configured to compensate for the sound leakage; generate tuning data including the sound profile; and apply the tuning data in the audio reproduction device to sonically customize the audio reproduction device.

In general, another innovative aspect of the subject matter described in this disclosure may be embodied in methods that include: determining an application environment associated with an audio reproduction device associated with a user; determining one or more sound profiles based on the application environment; providing the one or more sound profiles to the user; receiving a selection of a first sound profile from the one or more sound profiles; and generating tuning data based on the first sound profile, the tuning data configured to sonically customize the audio reproduction device.

Other aspects include corresponding methods, systems, apparatus, and computer program products for these and other innovative aspects.

These and other implementations may each optionally include one or more of the following operations and features. For instance, the features include: the application environment being a physical environment surrounding the audio reproduction device; the application environment describing an activity status of the user associated with the audio reproduction device; the activity status including one of running, walking, sitting, and sleeping; receiving sensor data; receiving location data describing a location associated with the user; determining the application environment based on the sensor data and the location data; the one or more sound profiles including at least one pre-programmed sound profile; monitoring audio content played in the audio reproduction device; determining a genre associated with the audio content; determining the one or more sound profiles further based on the genre associated with the audio content; determining a listening history associated with the user; determining the one or more sound profiles further based on the listening history; receiving image data; determining one or more deteriorating factors based on the image data; estimating a sound degradation caused by the one or more deteriorating factors; determining the one or more sound profiles further based on the estimated sound degradation; receiving data describing one or more user preferences; determining the one or more sound profiles further based on the one or more user preferences; monitoring background noise in the application environment; generating the one or more sound profiles that are configured to alleviate effect of the background noise; receiving device data describing the audio reproduction device; determining the one or more sound profiles further based on the device data; the device data including data describing a model of the audio reproduction device, and the one or more sound profiles including at least one pre-programmed sound profile configured for the model of the audio reproduction device; receiving data describing a target sound wave; determining the one or more sound profiles that emulate the target sound wave; and the tuning data including the first sound profile and data configured to adjust a volume of the audio reproduction device.

BRIEF DESCRIPTION OF THE DRAWINGS

The disclosure is illustrated by way of example, and not by way of limitation in the figures of the accompanying drawings in which like reference numerals are used to refer to similar elements.

DETAILED DESCRIPTION

Overview

Figure 1:
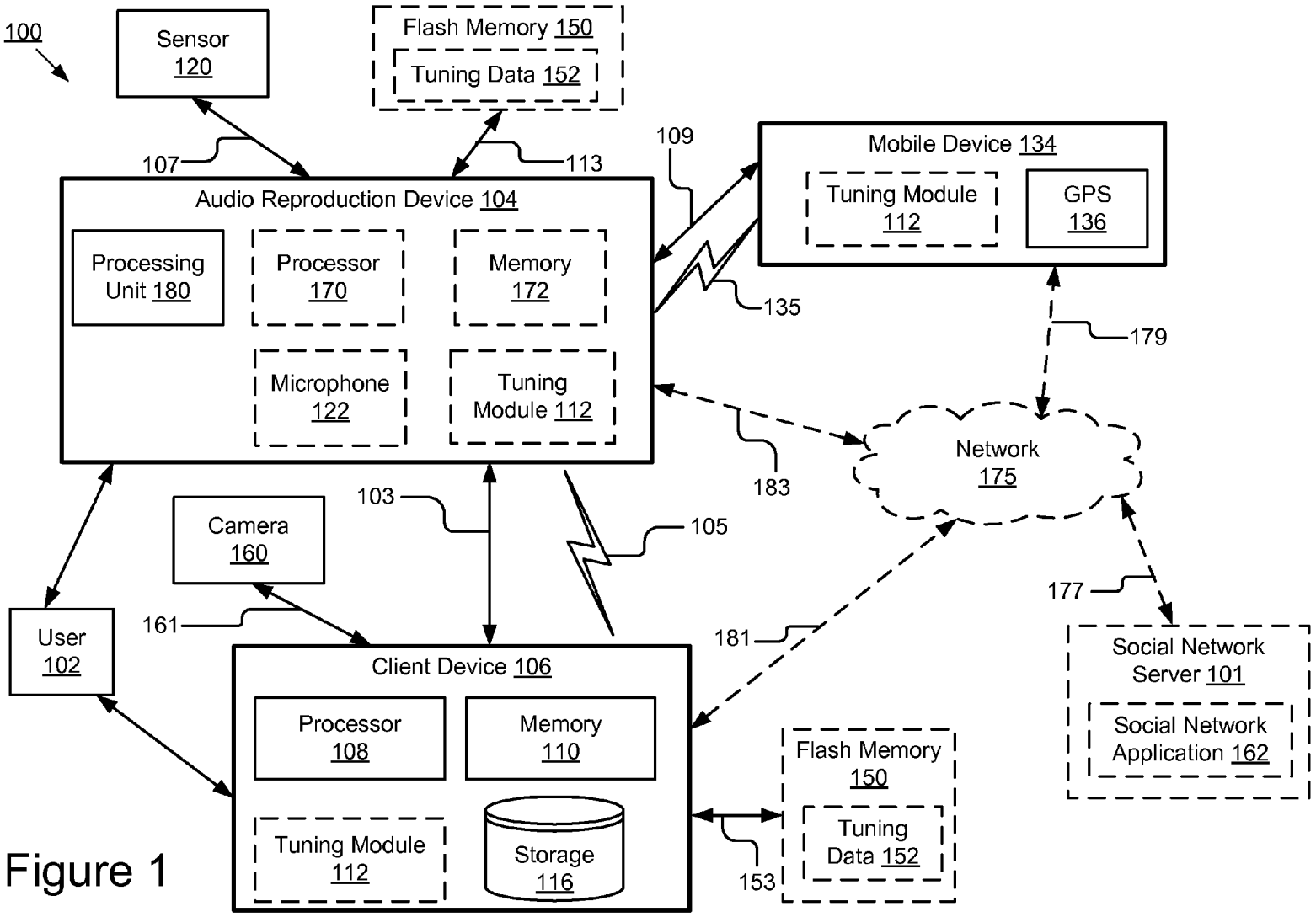
FIG. 1 is a block diagram illustrating an example system for sonically customizing an audio reproduction device for a user.

FIG. 1 illustrates a block diagram of some implementations of a system 100 for sonically customizing an audio reproduction device for a user. The illustrated system 100 includes an audio reproduction device 104, a client device 106 and a mobile device 134. A user 102 interacts with the audio reproduction device 104, the client device 106 and the mobile device 134. The system 100 optionally includes a social network server 101, which is coupled to a network 175 via signal line 177.

In the illustrated implementation, the entities of the system 100 are communicatively coupled to each other. For example, the audio reproduction device 104 is communicatively coupled to the mobile device 134 via signal line 109. The client device 106 is communicatively coupled to the audio reproduction device 104 via signal line 103. In some embodiments, the mobile device 134 is communicatively coupled to the audio reproduction device 104 via a wireless communication link 135, and the client device 106 is communicatively coupled to the audio reproduction device 104 via a wireless communication link 105. The wireless communication links 105 and 135 can be a wireless connection using an IEEE 802.11, IEEE 802.16, BLUETOOTH®, near field communication (NFC) or another suitable wireless communication method. In the illustrated embodiment, the audio reproduction device 104 is optionally coupled to the network 175 via signal line 183, the mobile device 134 is optionally coupled to the network 175 via signal line 179 and the client device 106 is optionally coupled to the network 175 via signal line 181.

The audio reproduction device 104 may include an apparatus for reproducing a sound wave from an audio signal. For example, the audio reproduction device 104 can be any type of audio reproduction device such as a headphone device, an earbud device, a speaker dock, a speaker system, a super-aural and a supra-aural headphone device, an in-ear headphone device, a headset or any other audio reproduction device. In one embodiment, the audio reproduction device 104 includes a cup, an ear pad coupled to a top edge of the cup and a driver coupled to the inner wall of the cup.

In one embodiment, the audio reproduction device 104 includes a processing unit 180. The processing unit 180 can be a module that applies tuning data 152 to tune the audio reproduction device 104. For example, the processing unit 180 can be a digital signal processing (DSP) chip that receives tuning data 152 from a tuning module 112 and applies a sound profile described by the tuning data 152 to tune the audio reproduction device 104. The tuning data 152 and the sound profile are described below in more detail.

In some embodiments, the audio reproduction device 104 optionally includes a processor 170, a memory 172, a microphone 122 and a tuning module 112.

The processor 170 includes an arithmetic logic unit, a microprocessor, a general purpose controller or some other processor array to perform computations and provide electronic display signals to a display device. Processor 170 processes data signals and may include various computing architectures including a complex instruction set computer (CISC) architecture, a reduced instruction set computer (RISC) architecture, or an architecture implementing a combination of instruction sets. Although the illustrated audio reproduction device 104 includes a single processor 170, multiple processors 170 may be included. Other processors, sensors, displays and physical configurations are possible.

The memory 172 stores instructions and/or data that may be executed by the processor 170. The instructions and/or data may include code for performing the techniques described herein. The memory 172 may be a dynamic random access memory (DRAM) device, a static random access memory (SRAM) device, Flash memory or some other memory device. In some implementations, the memory 172 also includes a non-volatile memory or similar permanent storage device and media including a hard disk drive, a floppy disk drive, a CD-ROM device, a DVD-ROM device, a DVD-RAM device, a DVD-RW device, a Flash memory device, or some other mass storage device for storing information on a more permanent basis.

The microphone 122 may include a device for recording a sound wave and generating microphone data that describes the sound wave. The microphone 122 transmits the microphone data describing the recorded sound wave to the tuning module 112. In one embodiment, the microphone 122 may be an inline microphone built into a wire that connects the audio reproduction device 104 to the client device 106 or the mobile device 134. In another embodiment, the microphone 122 is a microphone coupled to the inner wall of the cup for recording any sound inside the cup (e.g., a sound wave reproduced by the audio reproduction device 104, any noise inside the cup from the outer environment). In yet another embodiment, the microphone 122 may be a microphone coupled to the outer wall of the cup for recording any sound or noise in the outer environment. Although only one microphone 122 is illustrated in FIG. 1, the audio reproduction device 104 may include one or more microphones 122. For the avoidance of doubt, in some embodiments one or more microphones 122 are positioned inside the cup of a headphone that is the audio reproduction device 104, in other embodiments one or more microphones 122 are positioned outside of the cup of a headphone, and in yet other embodiments one or more microphones 122 are positioned inside the cup of the headphone while one or more other microphones 122 are positioned outside the cup of the headphone. A person having ordinary skill in the art will appreciate how positioning of the microphone 122 can vary depending on whether the audio reproduction device 104 is an earbud device, a speaker dock, a speaker system, a super-aural and a supra-aural headphone device, an in-ear headphone device, a headset or any other audio reproduction device.

The tuning module 112 comprises software code/instructions and/or routines for tuning an audio reproduction device 104. In one embodiment, the tuning module 112 is implemented using hardware such as a field-programmable gate array (FPGA) or an application-specific integrated circuit (ASIC). In another embodiment, the tuning module 112 is implemented using a combination of hardware and software. In some implementations, the tuning module 112 is operable on the audio reproduction device 104. In some other implementations, the tuning module 112 is operable on the client device 106. In some other implementations, the tuning module 112 is stored on the mobile device 134. The tuning module 112 is described below in more detail with reference to FIGS. 2-4B.

In one embodiment, the audio reproduction device 104 is communicatively coupled to a sensor 120 via signal line 107. For example, a sensor 120 is embedded in the audio reproduction device 104. The sensor 120 can be any type of sensors configured to collect any type of data. For example, the sensor 120 is one of the following: a light detection and ranging (LIDAR) sensor; an infrared detector; a motion detector; a thermostat; an accelerometer; a heart rate monitor; a barometer or other pressure sensor; a light sensor; and a sound detector, etc. The sensor 120 can be any sensor known in the art of processor-based computing devices. Although only one sensor 120 is illustrated in FIG. 1, one or more sensors 120 can be coupled to the audio reproduction device 104.

In some examples, a combination of different types of sensors 120 may be connected to the audio reproduction device 104. For example, the system 100 includes different sensors 120 measuring one or more of an acceleration or a deceleration, a velocity, a heart rate of a user, a time of the day, a location (e.g., a latitude, longitude and altitude of the location) or any physical parameters in a surrounding environment such as temperature, humidity, light, etc. The sensors 120 generate sensor data describing the measurement and send the sensor data to the tuning module 112. Other types of sensors 120 are possible.

In one embodiment, the audio reproduction device 104 is communicatively coupled to an optional Flash memory 150 via signal line 113. For example, the Flash memory 150 is connected to the audio reproduction device 104 via a universal serial bus (USB). Optionally, the Flash memory 150 stores tuning data 152 generated by the tuning module 112. In one embodiment, a user 102 connects a Flash memory 150 to the client device 106 or the mobile device 134, and the tuning module 112, operable on the client device 106 or the mobile device 134, stores the tuning data 152 in the Flash memory 150. The user 102 can connect the Flash memory 150 to the audio reproduction device 104, which retrieves the tuning data 152 from the Flash memory 150.

The tuning data 152 may include data for tuning an audio reproduction device 104. For example, the tuning data 152 includes data describing a sound profile used to equalize an audio reproduction device 104 and data used to automatically adjust a volume of the audio reproduction device 104. The tuning data 152 may include any other data for tuning an audio reproduction device 104. The sound profile is described below in more detail with reference to FIG. 2.

In one embodiment, the tuning data 152 may be generated by the tuning module 112 operable in the client device 106. The tuning data 152 may be transmitted from the client device 106 to the processing unit 180 included in the audio reproduction device 104 via signal line 103 or the wireless communication link 105. For example, the tuning module 112 generates and transmits the tuning data 152 from the client device 106 to the processing unit 180 via a wired connection (e.g., a universal serial bus (USB), a LIGHTNING® connector, etc.) or a wireless connection (e.g., BLUETOOTH®, wireless fidelity (Wi-Fi)), causing the processing unit 180 to update a sound profile applied in the audio reproduction device 104 based on the received tuning data 152. In another embodiment, the tuning data 152 may be generated by the tuning module 112 operable on the mobile device 134. The tuning data 152 may be transmitted from the mobile device 134 to the processing unit 180 included in the audio reproduction device 104 via signal line 109 or the wireless communication link 135, causing the processing unit 180 to update a sound profile applied in the audio reproduction device 104 based on the received tuning data 152. In yet another embodiment, the tuning data 152 may be generated by the tuning module 112 operable on the audio reproduction device 104. The tuning module 112 sends the tuning data 152 to the processing unit 180, causing the processing unit 180 to update a sound profile applied in the audio reproduction device 104 based on the received tuning data 152. In either embodiment, the processing unit 180 sonically customizes the audio reproduction device 104 based on the tuning data 152. For example, the processing unit 180 tunes the audio reproduction device 104 using the tuning data 152. In either embodiment, the processing unit 180 may continuously and dynamically update the sound profiled applied in the audio reproduction device 104.

In one embodiment, the tuning module 112, operable on the client device 106 or the mobile device 134, generates tuning data 152 including a sound profile, and stores the tuning data 152 in the Flash memory 150 connected to the client device 106 or the mobile device 134. A user can connect the Flash memory 150 to the audio reproduction device 104, causing the processing unit 180 to retrieve the sound profile stored in the Flash memory 150 and to apply the sound profile to the audio reproduction device 104 when the user 102 uses the audio reproduction device 104 to listen to audio content.

The client device 106 may be a computing device that includes a memory 110 and a processor 108, for example a laptop computer, a desktop computer, a tablet computer, a mobile telephone, a personal digital assistant (PDA), a mobile email device, a portable game player, a portable music player, a reader device, a television with one or more processors embedded therein or coupled thereto or other electronic device capable of accessing a network 175. The processor 108 provides similar functionality as those described above for the processor 170, and the description will not be repeated here. The memory 110 provides similar functionality as those described above for the memory 172, and the description will not be repeated here. The client device 106 may include the tuning module 112 and a storage device 116. The storage device 116 is described below with reference to FIG. 2.

In one embodiment, the client device 106 is communicatively coupled to an optional Flash memory 150 via signal line 153. For example, the Flash memory 150 is connected to the client device 106 via a universal serial bus (USB). In another embodiment, the client device 106 is communicatively coupled to one or more sensors 120. In yet another embodiment, the client device 106 is communicatively coupled to a camera 160 via signal line 161. The camera 160 is an optical device for recording images. For example, the camera 160 records an image that depicts a user 102 wearing a beanie and a headset over the beanie. In another example, the camera 160 records an image of a user 102 that has long hair and wears a headset over the head. The camera 160 sends image data describing the image to the tuning module 112.

The mobile device 134 may be a computing device that includes a memory and a processor, for example, a laptop computer, a tablet computer, a mobile telephone, a personal digital assistant (PDA), a mobile email device, a portable game player, a portable music player, a reader device, or any other mobile electronic device capable of accessing a network 175. The mobile device 134 may include the tuning module 112 and a global positioning system (GPS) 136. The GPS system 136 provides data describing one or more of a time, a location, a map, a speed, etc., associated with the mobile device 134. In one embodiment, the mobile device 134 is communicatively coupled to an optional Flash memory 150 for storing tuning data 152. In another embodiment, the mobile device 134 is communicatively coupled to one or more sensors 120. In yet another embodiment, the mobile device 134 is communicatively coupled to a camera 160.

The optional network 175 can be a conventional type, wired or wireless, and may have numerous different configurations including a star configuration, token ring configuration or other configurations. Furthermore, the network 175 may include a local area network (LAN), a wide area network (WAN) (e.g., the Internet), and/or other interconnected data paths across which multiple devices may communicate. In some implementations, the network 175 may be a peer-to-peer network. The network 175 may also be coupled to or includes portions of a telecommunications network for sending data in a variety of different communication protocols. In some implementations, the network 175 includes a BLUETOOTH® communications network or a cellular communications network for sending and receiving data including via short messaging service (SMS), multimedia messaging service (MMS), hypertext transfer protocol (HTTP), direct data connection, wireless application protocol (WAP), email, etc. Although only one network 175 is illustrated in FIG. 1, the system 100 can include one or more networks 175.

The social network server 101 may include any computing device having a processor (not pictured) and a computer-readable storage medium (not pictured) storing data for providing a social network to users. Although only one social network server 101 is shown in FIG. 1, multiple social network servers 101 may be present. A social network is any type of social structure where the users are connected by a common feature including friendship, family, work, an interest, etc. The common features are provided by one or more social networking systems, such as those included in the system 100, including explicitly-defined relationships and relationships implied by social connections with other users, where the relationships are defined in a social graph. The social graph is a mapping of all users in a social network and how they are related to each other.

In the depicted embodiment, the social network server 101 includes a social network application 162. The social network application 162 includes code and routines stored on a memory (not pictured) of the social network server 101 that, when executed by a processor (not pictured) of the social network server 101, causes the social network server 101 to provide a social network accessible by users 102. In one embodiment, a user 102 publishes comments on the social network. For example, a user 102 provides a brief review of a headset product on the social network and other users 102 post comments on the brief review.

Tuning Module

Figure 2:
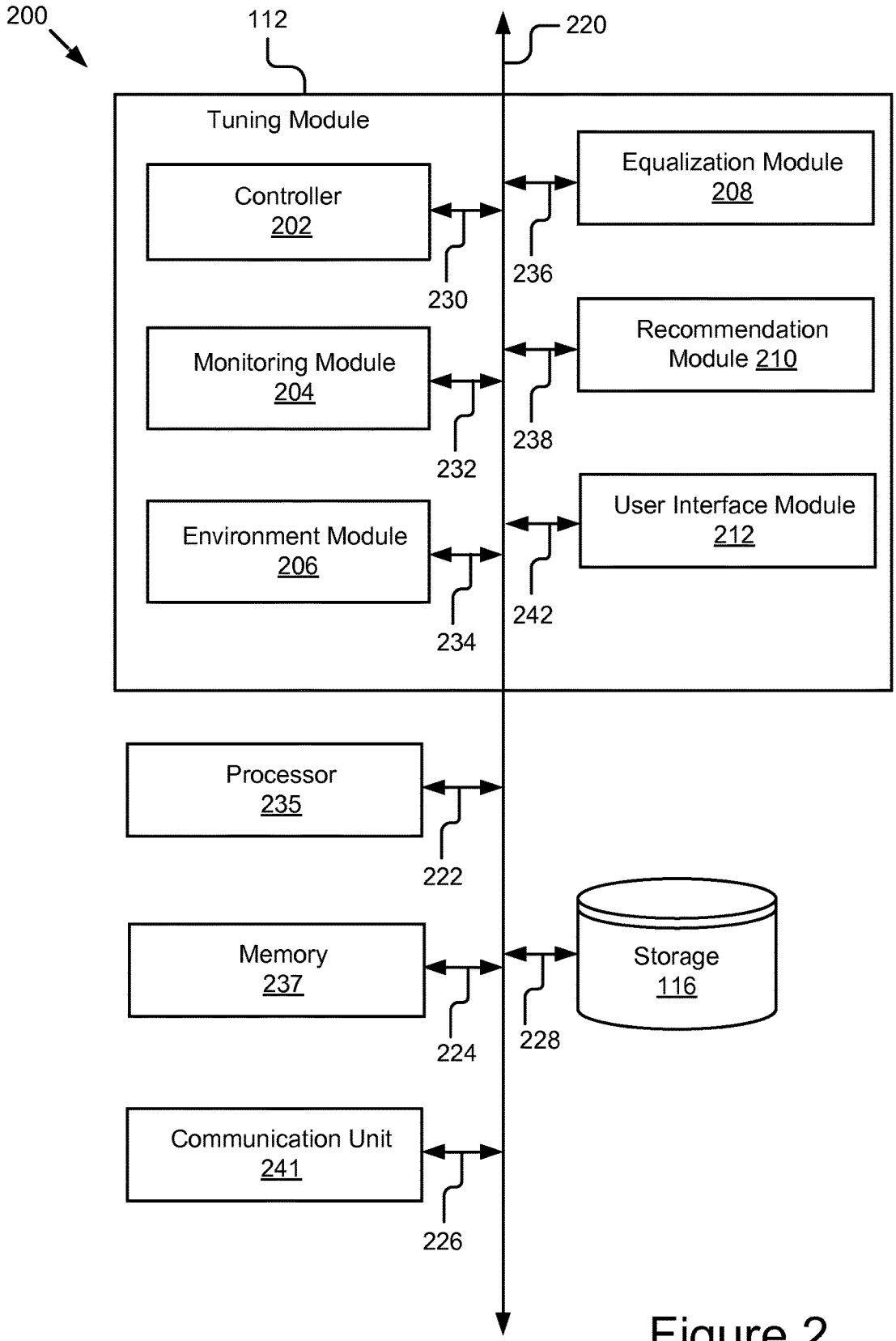
FIG. 2 is a block diagram illustrating an example tuning module.

Referring now to FIG. 2, an example of the tuning module 112 is shown in more detail. FIG. 2 is a block diagram of a computing device 200 that includes a tuning module 112, a processor 235, a memory 237, a communication unit 241 and a storage device 116, according to some examples. The components of the computing device 200 are communicatively coupled by a bus 220. In some implementations, the computing device 200 can be one of an audio reproduction device 104, a client device 106 and a mobile device 134.

The processor 235 is communicatively coupled to the bus 220 via signal line 222. The processor 235 provides similar functionality as those described for the processor 170, and the description will not be repeated here. The memory 237 is communicatively coupled to the bus 220 via signal line 224. The memory 237 provides similar functionality as those described for the memory 172, and the description will not be repeated here.

The communication unit 241 transmits and receives data to and from at least one of the client device 106, the audio reproduction device 104 and the mobile device 134. The communication unit 241 is coupled to the bus 220 via signal line 226. In some implementations, the communication unit 241 includes a port for direct physical connection to the network 175 or to another communication channel. For example, the communication unit 241 includes a USB, SD, CAT-5 or similar port for wired communication with the client device 106. In some implementations, the communication unit 241 includes a wireless transceiver for exchanging data with the client device 106 or other communication channels using one or more wireless communication methods, including IEEE 802.11, IEEE 802.16, BLUETOOTH® or another suitable wireless communication method.

In some implementations, the communication unit 241 includes a cellular communications transceiver for sending and receiving data over a cellular communications network including via short messaging service (SMS), multimedia messaging service (MMS), hypertext transfer protocol (HTTP), direct data connection, WAP, e-mail or another suitable type of electronic communication. In some implementations, the communication unit 241 includes a wired port and a wireless transceiver. The communication unit 241 also provides other conventional connections to the network 175 for distribution of files and/or media objects using standard network protocols including TCP/IP, HTTP, HTTPS and SMTP, etc.

The storage device 116 can be a non-transitory memory that stores data for providing the functionality described herein. The storage device 116 may be a dynamic random access memory (DRAM) device, a static random access memory (SRAM) device, Flash memory or some other memory devices. In some implementations, the storage device 116 also includes a non-volatile memory or similar permanent storage device and media including a hard disk drive, a floppy disk drive, a CD-ROM device, a DVD-ROM device, a DVD-RAM device, a DVD-RW device, a Flash memory device, or some other mass storage device for storing information on a more permanent basis. In the illustrated implementation, the storage device 116 is communicatively coupled to the bus 220 via a wireless or wired signal line 228.

In some implementations, the storage device 116 stores one or more of: device data describing an audio reproduction device 104 used by a user; content data describing audio content listened to by a user; sensor data; location data; environment data describing an application environment associated with an audio reproduction device 104; social graph data associated with one or more users; tuning data for an audio reproduction device 104; and recommendations for a user. The data stored in the storage device 116 is described below in more detail. In some implementations, the storage device 116 may store other data for providing the functionality described herein.

In some examples, the social graph data associated with a user includes one or more of: (1) data describing associations between the user and one or more other users connected in a social graph (e.g., friends, family members, colleagues, etc.); (2) data describing one or more engagement actions performed by the user (e.g., endorsements, comments, sharing, posts, reposts, etc.); (3) data describing one or more engagement actions performed by one or more other users connected to the user in a social graph (e.g., friend's endorsements, comments, posts, etc.) with the consent from the one or more other users; and (4) a user profile describing the user (e.g., gender, interests, hobbies, demographic data, education experience, working experience, etc.). The retrieved social graph data may include other data obtained from the social network server 101 upon the consent from users.

In the illustrated implementation shown in FIG. 2, the tuning module 112 includes a controller 202, a monitoring module 204, an environment module 206, an equalization module 208, a recommendation module 210 and a user interface module 212. These components of the tuning module 112 are communicatively coupled to each other via the bus 220.

The controller 202 can be software including routines for handling communications between the tuning module 112 and other components of the computing device 200. In some implementations, the controller 202 can be a set of instructions executable by the processor 235 to provide the functionality described below for handling communications between the tuning module 112 and other components of the computing device 200. In some implementations, the controller 202 can be stored in the memory 237 of the computing device 200 and can be accessible and executable by the processor 235. The controller 202 may be adapted for cooperation and communication with the processor 235 and other components of the computing device 200 via signal line 230.

The controller 202 sends and receives data, via the communication unit 241, to and from one or more of a client device 106, an audio reproduction device 104, a mobile device 134 and a social network server 101. For example, the controller 202 receives, via the communication unit 241, data describing social graph data associated with a user from the social network server 101 and sends the data to the recommendation module 210. In another example, the controller 202 receives graphical data for providing a user interface to a user from the user interface module 212 and sends the graphical data to a client device 106 or a mobile device 134, causing the client device 106 or the mobile device 134 to present the user interface to the user.

In some implementations, the controller 202 receives data from other components of the tuning module 112 and stores the data in the storage device 116. For example, the controller 202 receives graphical data from the user interface module 212 and stores the graphical data in the storage device 116. In some implementations, the controller 202 retrieves data from the storage device 116 and sends the retrieved data to other components of the tuning module 112. For example, the controller 202 retrieves preference data describing one or more user preferences from the storage 116 and sends the data to the equalization module 208 or the recommendation module 210.

The monitoring module 204 can be software including routines for monitoring an audio reproduction device 104. In some implementations, the monitoring module 204 can be a set of instructions executable by the processor 235 to provide the functionality described below for monitoring the audio reproduction device 104. In some implementations, the monitoring module 204 can be stored in the memory 237 of the computing device 200 and can be accessible and executable by the processor 235. The monitoring module 204 may be adapted for cooperation and communication with the processor 235 and other components of the computing device 200 via signal line 232.

In one embodiment, the monitoring module 204 monitors audio content being played by the audio reproduction device 104. For example, the monitoring module 204 receives content data describing audio content played in the audio reproduction device 104 from the client device 106 or the mobile device 134, and determines a genre of the audio content (e.g., rock music, pop music, jazz music, an audio book, etc.). The monitoring module 204 sends the genre of the audio content to the equalization module 208 or the recommendation module 210. In another example, the monitoring module 204 determines a listening history of a user that describes audio files listened to by the user, and sends the listening history to the equalization module 208 or the recommendation module 210.

In another embodiment, the monitoring module 204 receives data describing the audio reproduction device 104 from one or more of the audio reproduction device 104, the client device 106 and the mobile device 134, and identifies the audio reproduction device 104 based on the received data. For example, the monitoring module 204 receives data describing a serial number of the audio reproduction device 104 and identifies a brand and a model associated with the audio reproduction device 104 using the serial number. In another example, the monitoring module 204 receives image data depicting a user wearing the audio reproduction device 104 from the camera 160 and identifies the audio reproduction device 104 using image processing techniques. The monitoring module 204 sends device data identifying the audio reproduction device 104 to the equalization module 208. Example device data include, but are not limited to, a brand name, a model number, an identification code (e.g., a bar code, a quick response (QR) code), a serial number and a generation of the device, etc.

In yet another embodiment, the monitoring module 204 receives microphone data recording a sound wave played by the audio reproduction device 104 from the microphone 122, and determines a sound quality of the sound wave using the microphone data. For example, the monitoring module 204 determines a background noise level in the sound wave. In another example, the monitoring module 204 determines whether the sound wave matches at least one of a target sound signature and a sound signature within a target sound range. A sound signature may include, for example, a sound pressure level of a sound wave. A target sound signature may include a sound signature of a target sound wave that an audio reproduction device 104 aims to reproduce. For example, a target sound signature may describe a sound pressure level of a target sound wave. A target sound range may include a range within which a target sound signature lies in. In one embodiment, a target sound range has a lower limit and an upper limit.

In one embodiment, the monitoring module 204 receives sensor data from a sensor 120 (e.g., pressure data from a pressure detector) and determines a sealing quality of the cups of the audio reproduction device 104. For example, the monitoring module 204 determines whether the cups are completely sealed to the user's ears. If the cups are not completely sealed to the user's ears, the recommendation module 210 may recommend the user to adjust the cups of the audio reproduction device 104.

The environment module 206 can be software including routines for determining an application environment associated with an audio reproduction device 104. In some implementations, the environment module 206 can be a set of instructions executable by the processor 235 to provide the functionality described below for determining an application environment associated with an audio reproduction device 104. In some implementations, the environment module 206 can be stored in the memory 237 of the computing device 200 and can be accessible and executable by the processor 235. The environment module 206 may be adapted for cooperation and communication with the processor 235 and other components of the computing device 200 via signal line 234.

An application environment may describe an application scenario where the audio reproduction device 104 is applied to play audio content. In one embodiment, an application environment is a physical environment surrounding an audio reproduction device 104. For example, an application environment may be an environment in an office, an environment in an open field, an environment in a stadium during a sporting event or concert, an environment on a train/subway, an indoor environment, an environment inside a tunnel, an environment on a playground, etc. In another embodiment, an application environment of the audio reproduction device 104 describes a status of a user that is using the audio reproduction device 104 to play audio content. For example, an application environment indicates an activity status of a user that is wearing the audio reproduction device 104. For example, an application environment indicates a user is running, walking on a street or sitting in an office while listening to music using a headset. In another example, an application environment indicates a user is running with a heartbeat rate of 130 beats per minute while listening to music using a pair of earbuds. Other example application environments are possible.

In one embodiment, the environment module 206 receives one or more of sensor data from one or more sensors 120, GPS data (e.g., location data describing a location, a time of the day, etc.) from the GPS system 136 and map data from a map server (not shown). The environment module 206 determines an application environment for the audio reproduction device 104 based on one or more of the sensor data, the GPS data and the map data. For example, the environment module 206 determines that a user is running in a park while listening to music using a headset based on the location data received from the GPS system 136, map data from the map server and speed data received from an accelerometer. The environment module 206 sends data describing the application environment to the equalization module 208.

In another embodiment, the environment module 206 receives data describing a weather condition (e.g., rainy, windy, sunny, etc.) and/or data describing a scheduled event (e.g., a concert, a parade, a sports game, etc.). In some instances, the data may be received from one or more web servers (not pictured) or the social network server 101 via the network 175. In some other instances, the data may be received from one or more applications (e.g., a weather application, a calendar application, etc.) stored on the client device 106 or the mobile device 134. The environment module 206 generates an application environment for the audio reproduction device 104 that includes the weather condition and/or the scheduled event.

The equalization module 208 can be software including routines for equalizing an audio reproduction device 104. In some implementations, the equalization module 208 can be a set of instructions executable by the processor 235 to provide the functionality described below for equalizing an audio reproduction device 104. In some implementations, the equalization module 208 can be stored in the memory 237 of the computing device 200 and can be accessible and executable by the processor 235. The equalization module 208 may be adapted for cooperation and communication with the processor 235 and other components of the computing device 200 via signal line 236.

In one embodiment, the equalization module 208 receives data indicating a genre of audio content being played by the audio reproduction device 104 from the monitoring module 204 and determines a pre-programmed sound profile for the audio reproduction device 104 based on the genre of audio content. A sound profile may include data for adjusting an audio reproduction device 104. For example, a sound profile may include equalization data applied to equalize an audio reproduction device 104. In one embodiment, a pre-programmed sound profile may be configured for a specific genre of music. For example, if the audio signal is related to rock music, the equalization module 208 filters the audio signal using a pre-programmed sound profile customized for rock music. In another embodiment, a pre-programmed sound profile may be configured to boost sound quality at certain frequencies. For example, a pre-programmed sound profile applies a bass booster to an audio signal to improve sound quality in the bass.

In another embodiment, the equalization module 208 receives data describing a listening history, of a user that wears an audio reproduction device 104, from the monitoring module 204 and determines a pre-programmed sound profile for the audio reproduction device 104 based on the listening history. The listening history includes, for example, all the audio content listened to by the user using the audio reproduction device 104 and listening volume. In yet another embodiment, the equalization module 208 receives device data describing the audio reproduction device 104 from the monitoring module 204, and determines a pre-programmed sound profile for the audio reproduction device 104 based on the device data. For example, the pre-programmed sound profile is a sound profile optimized for the specific model of the audio reproduction device 104.

In one embodiment, the equalization module 208 receives preference data describing user preferences and social graph data associated with the user from the social network server 101. The equalization module 208 determines a sound profile to be applied to sonically customize the audio reproduction device 104 based on the preference data and the social graph data. For example, if the preference data indicates the user prefers high quality bass, the equalization module 208 generates a sound profile that boosts sound quality in the bass. In another example, if the social graph data indicates that the user has endorsed a headset that produces a smooth sound, the equalization module 208 generates a sound profile that enhances smoothness of the sound reproduced by the audio reproduction device 104.

In one embodiment, the user interface module 212 generates graphical data for providing a user interface to a user, allowing the user to input one or more preferences via the user interface. For example, the user can specify a favorite genre of music and a preferred sound profile (e.g., high quality bass, sound smoothness, tonal balance, etc.), etc., via the user interface. The equalization module 208 generates a sound profile for the user based on the received data. For example, the equalization module 208 generates a sound profile based on the genre of music and one or more user preferences. The equalization module 208 stores the sound profile in the Flash memory 150 as part of the tuning data 152. In one embodiment, the processing unit 180 retrieves the sound profile from the Flash memory 150 connected to the audio reproduction device 104, and applies the sound profile to the audio reproduction device 104 when the user uses the audio reproduction device 104 to listen to music.

In another embodiment, the equalization module 208 receives data describing an application environment associated with the audio reproduction device 104, and adjusts the audio reproduction device 104 based on the application environment. For example, if the application environment indicates the user is walking on a street while listening to music, the equalization module 208 may increase or decrease a volume in the audio reproduction device 104 depending on a current volume of the audio reproduction device 104. In another example, the equalization module 208 determines a sound profile for the audio reproduction device 104 based on the application environment. For example, if the application environment indicates the user is sitting in a park and reading a book using the mobile device 134, the equalization module 208 generates a sound profile customized for reading for the audio reproduction device 104. In another example, if the application environment indicates the user is running in a park with a heartbeat rate of 120 beats per minute, the equalization module 208 may automatically adjust the volume of the audio reproduction device 104 (e.g., increasing the volume or decreasing the volume) or generate a sound profile for the audio reproduction device 104 based on the heartbeat rate. For example, the equalization module 208 generates a sound profile that adjusts a sound pressure level (SPL) curve for the audio reproduction device 104. In one embodiment, the equalization module 208 is configured to update the sound profile for the audio reproduction device 104 in response to that the application environment is changed.

In one embodiment, the equalization module 208 receives data indicating a background noise in the environment from the monitoring module 204 and generates a sound profile that minimizes the effect of the background noise for the audio reproduction device 104. In another embodiment, the equalization module 208 receives data indicating a sound wave reproduced by the audio reproduction device 104 does not match a target sound signature, and generates a sound profile to emulate the target sound signature.

In yet another embodiment, the equalization module 208 receives image data depicting a user wearing the audio reproduction device 104 and determines one or more deteriorating factors from the image data. A deteriorating factor may be a factor that may deteriorate a sound quality of an audio reproduction device 104. Examples of a deteriorating factor include, but are not limited to: long hair; wearing a beanie or a cap while wearing an audio reproduction device 104 over the head; wearing a pair of glasses; wearing a wig; and wearing a mask, etc. The equalization module 208 estimates a sound leakage from the cups of the audio reproduction device 104 caused by the one or more deteriorating factors and generates a sound profile to compensate for the sound degradation caused by the one or more deteriorating factors.

In some embodiments, the equalization module 208 generates tuning data 152 for tuning the audio reproduction device 104. The tuning data 152 includes the sound profile, data for adjusting a volume of the audio reproduction device 104 and any other data for tuning the audio reproduction device 104. For example, the equalization module 208 generates the sound profile and data for adjusting the volume of the audio reproduction device 104 by performing operations similar to those described above. In some implementations, the equalization module 208 sends the tuning data 152 to the recommendation module 210, causing the recommendation module 210 to provide one or more tuning suggestions to the user based on the tuning data 152. In some other implementations, the equalization module 208 sends the tuning data 152 to the audio reproduction device 104, causing the audio reproduction device 104 to be adjusted automatically based on the tuning data 152.

The recommendation module 210 can be software including routines for providing one or more recommendations to users. In some implementations, the recommendation module 210 can be a set of instructions executable by the processor 235 to provide the functionality described below for providing one or more recommendations to users. In some implementations, the recommendation module 210 can be stored in the memory 237 of the computing device 200 and can be accessible and executable by the processor 235. The recommendation module 210 may be adapted for cooperation and communication with the processor 235 and other components of the computing device 200 via signal line 238.

In one embodiment, the recommendation module 210 receives one or more of preference data, social graph data associated with the user from the social network server 101 and tuning data 152 from the recommendation module 210. The recommendation module 210 determines one or more recommendations for the user based on one or more of the preference data, the social graph data and the tuning data 152. In some instances, the recommendation module 210 generates one or more tuning suggestions for tuning the audio reproduction device 104 based on the tuning data 152. For example, the recommendation module 210 recommends the user to choose one of the sound profiles to be applied in the audio reproduction device 104. In some instances, the recommendations module 210 determines music recommendation for the user based on the preference data and/or the social graph data. For example, the recommendation module 210 recommends one or more songs that the user's friends have endorsed on a social network to the user. In some instances, the recommendation module 210 recommends to the user one or more other audio reproduction devices 104 that are similar to the audio reproduction device 104 used by the user. Other example recommendations are possible.

The recommendation module 210 provides the one or more recommendations to the user. For example, the recommendation module 210 instructs the user interface module 212 to generate graphical data for providing a user interface that depicts the one or more recommendations to the user.

The user interface module 212 can be software including routines for generating graphical data for providing user interfaces to users. In some implementations, the user interface module 212 can be a set of instructions executable by the processor 235 to provide the functionality described below for generating graphical data for providing user interfaces to users. In some implementations, the user interface module 212 can be stored in the memory 237 of the computing device 200 and can be accessible and executable by the processor 235. The user interface module 212 may be adapted for cooperation and communication with the processor 235 and other components of the computing device 200 via signal line 242.

In some implementations, the user interface module 212 generates graphical data for providing a user interface that presents one or more recommendations to a user. The user interface module 212 sends the graphical data to a client device 106 or a mobile device 134, causing the client device 106 or the mobile device 134 to present the user interface to the user. In some examples, the user interface depicts one or more sound profiles, allowing the user to select one of the sound profiles to be applied in the audio reproduction device 104. The user interface module 212 may generate graphical data for providing other user interfaces to users.

Figure 3:
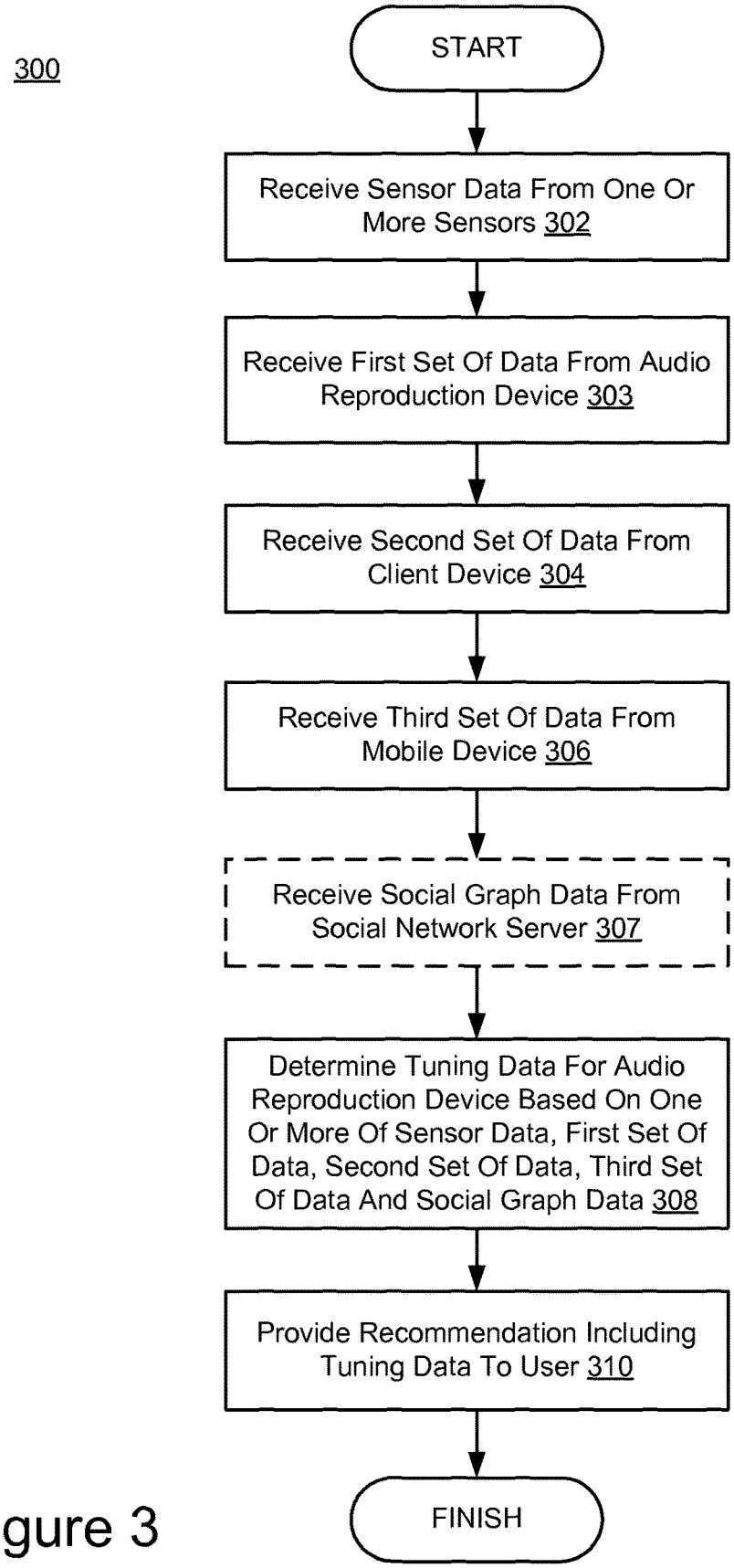
FIG. 3 is a flowchart of an example method for sonically customizing an audio reproduction device for a user.

FIG. 3 is a flowchart of an example method 300 for sonically customizing an audio reproduction device 104 (see FIG. 1) for a user. The controller 202 receives 302 sensor data from one or more sensors 120. The controller 202 receives 303 a first set of data from the audio reproduction device 104. The controller 202 receives 304 a second set of data from the client device 106. The controller 202 receives 306 a third set of data from the mobile device 134. Optionally, the controller 202 receives 307 social graph data associated with the user from the social network server 101. The equalization module 208 determines 308 tuning data 152 for the audio reproduction device 104 based on one or more of the sensor data, the first set of data, the second set of data, the third set of data and the social graph data. The recommendation module 210 generates one or more recommendations based on the tuning data 152 and provides 310 the one or more recommendations to the user.

Figure 4A:
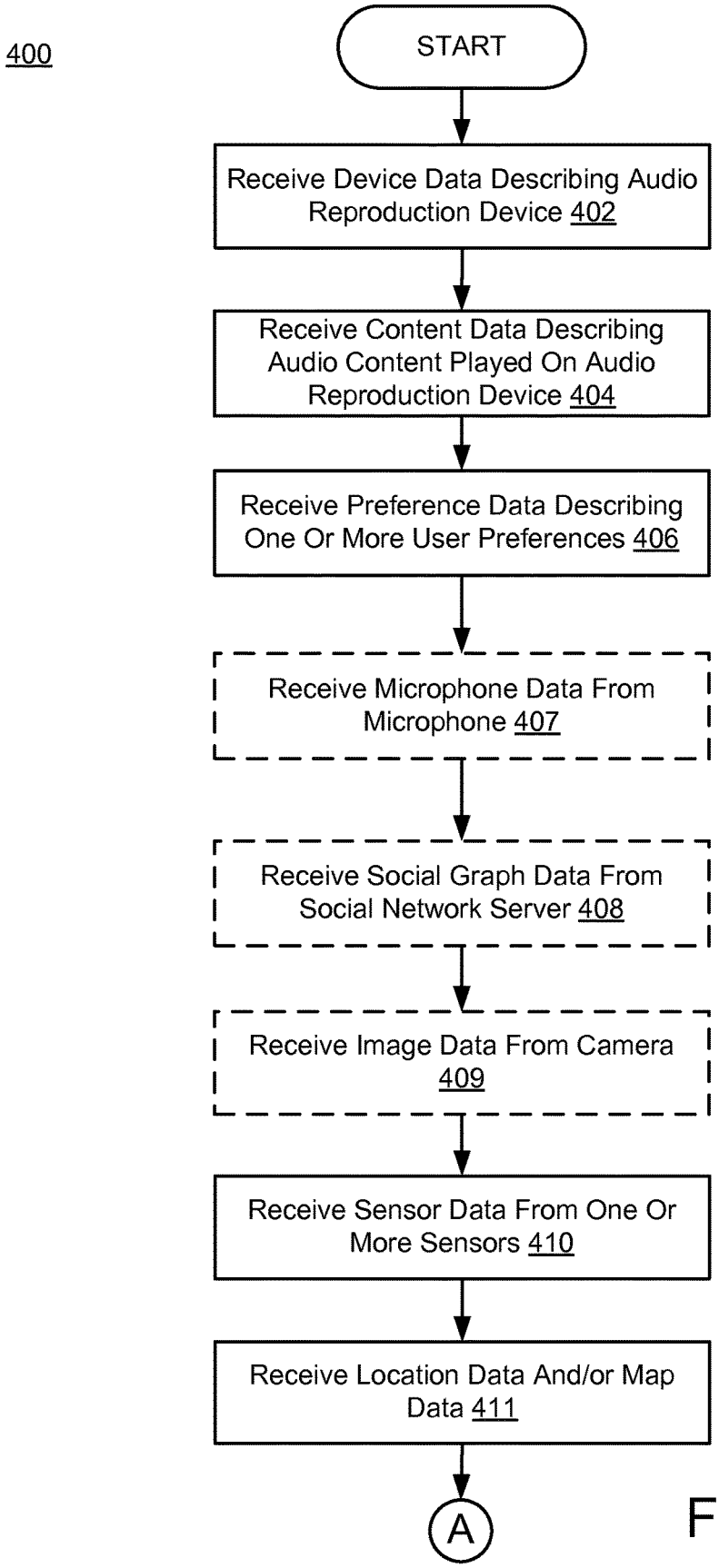
FIGS. 4A and 4B are flowcharts of another example method for sonically customizing an audio reproduction device for a user.
Figure 4B:
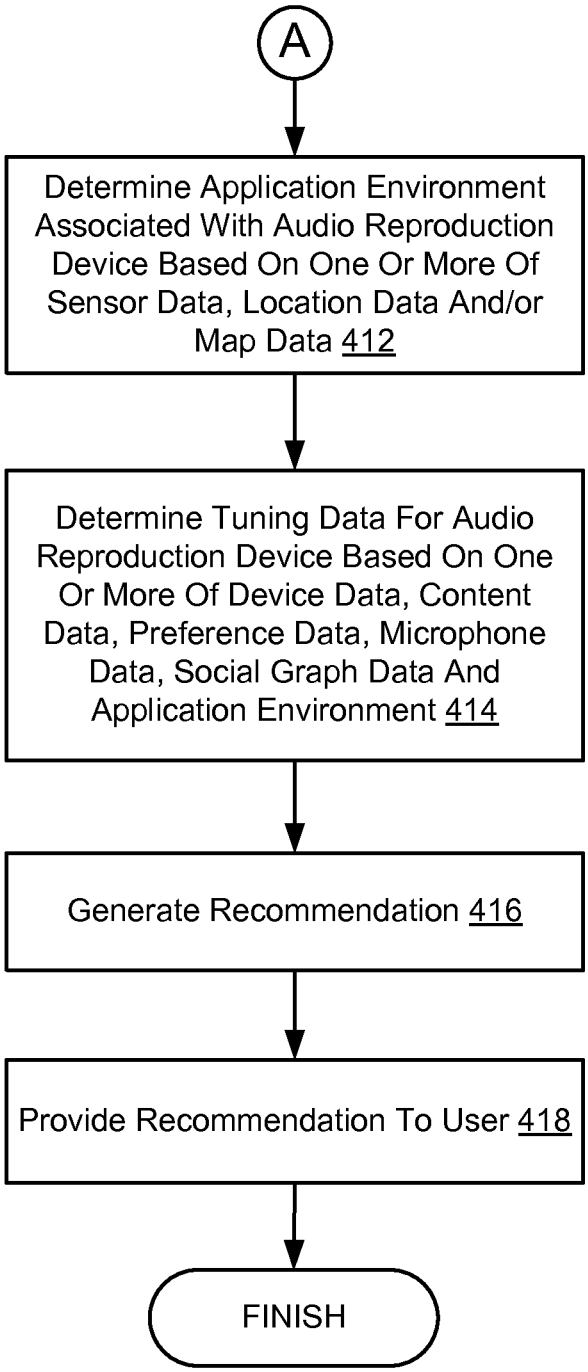

FIGS. 4A and 4B are flowcharts of another example method 400 for sonically customizing an audio reproduction device 104 (see FIG. 1) for a user. Referring to FIG. 4A, the controller 202 receives 402 device data describing the audio reproduction device 104. The controller 202 receives 404 content data describing audio content played on the audio reproduction device 104. The controller 202 receives 406 preference data describing one or more user preferences. Optionally, the controller 202 receives 407 microphone data from the microphone 122. Optionally, the controller 202 receives 408 social graph data associated with the user from the social network server 101 with the consent from the user. Optionally, the controller 202 receives 409 image data from the camera 160. The controller 202 receives 410 sensor data from one or more sensors 120. The controller 202 receives 411 location data from the GPS system 136 and map data from a map server (not shown).

Referring to FIG. 4B, the environment module 206 determines 412 an application environment associated with the audio reproduction device 104 based on one or more of the sensor data, the location data and the map data. The equalization module 208 determines 414 the tuning data 152 including a sound profile for the audio reproduction device 104 based on one or more of the device data, the content data, the preference data, the microphone data, the image data, the social graph data and the application environment. The recommendation module 210 generates 416 one or more recommendations using the tuning data 152. The recommendation module 210 provides 418 the one or more recommendations to the user.

Figure 5:
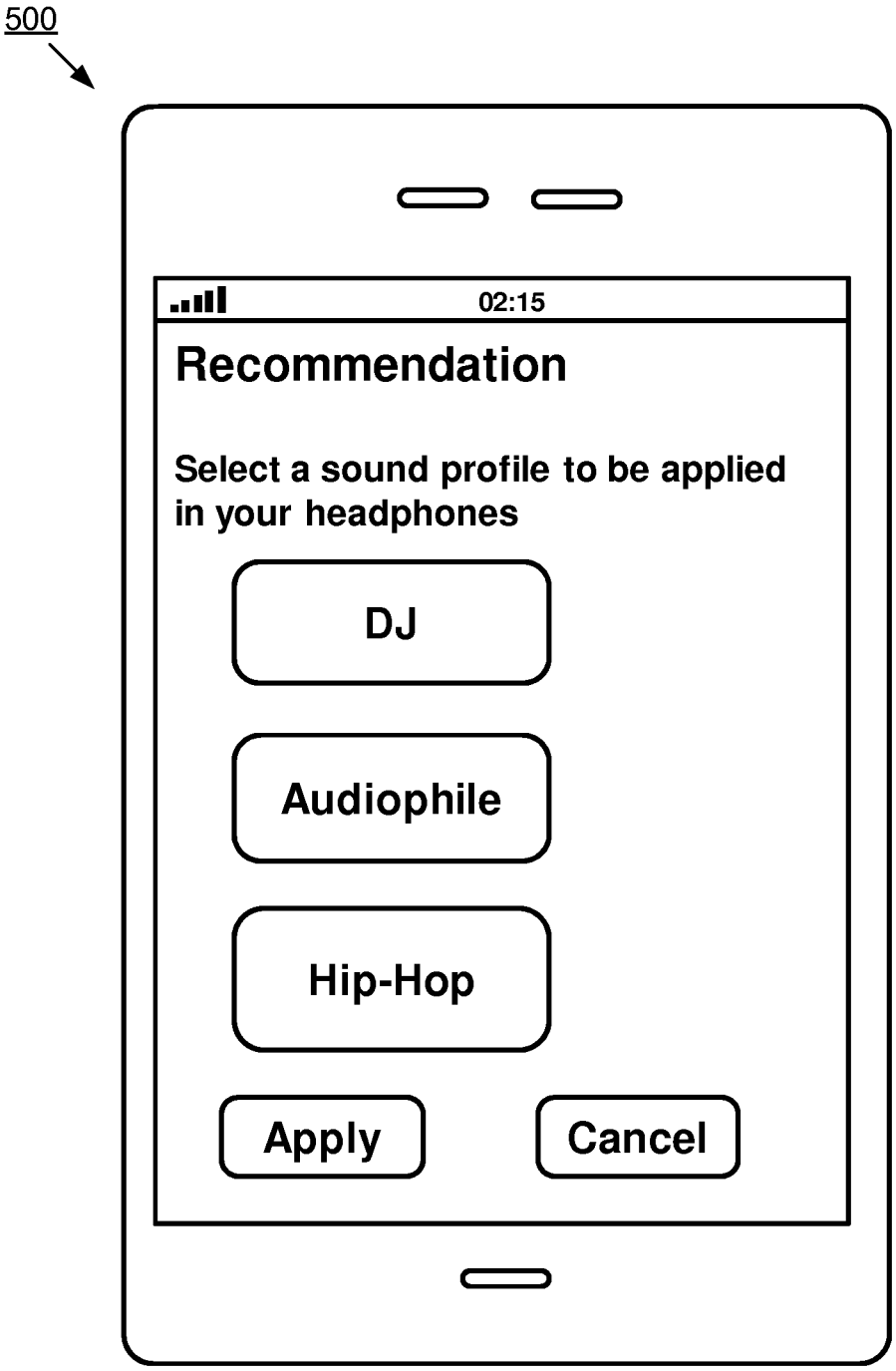
FIG. 5 is a graphic representation of an example user interface for providing one or more recommendations to a user.

FIG. 5 is a graphic representation 500 of an example user interface for providing one or more recommendations to a user. In the illustrated user interface, a user can select a sound profile to be applied in the audio reproduction device 104. A similar user interface can be provided for a user to select a sound profile via a client device 106 (e.g., a personal computer communicatively coupled to a monitor).

In the above description, for purposes of explanation, numerous specific details are set forth in order to provide a thorough understanding of the specification. It will be apparent, however, to one skilled in the art that the disclosure can be practiced without these specific details. In other implementations, structures and devices are shown in block diagram form in order to avoid obscuring the description. For example, the present implementation is described in one implementation below primarily with reference to user interfaces and particular hardware. However, the present implementation applies to any type of computing device that can receive data and commands, and any peripheral devices providing services.

Reference in the specification to "one implementation" or "an implementation" means that a particular feature, structure, or characteristic described in connection with the implementation is included in at least one implementation of the description. The appearances of the phrase "in one implementation" in various places in the specification are not necessarily all referring to the same implementation.

Some portions of the detailed description that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms including "processing" or "computing" or "calculating" or "determining" or "displaying" or the like, refer to the actions and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present implementation of the specification also relates to an apparatus for performing the operations herein. This apparatus may be specially constructed for the required purposes, or it may comprise a general-purpose computer selectively activated or reconfigured by a computer program stored in the computer. Such a computer program may be stored in a computer-readable storage medium, including, but not limited to, any type of disk including floppy disks, optical disks, CD-ROMs, and magnetic disks, read-only memories (ROMs), random access memories (RAMs), EPROMs, EEPROMs, magnetic or optical cards, Flash memories including USB keys with non-volatile memory or any type of media suitable for storing electronic instructions, each coupled to a computer system bus.

The specification can take the form of an entirely hardware implementation, an entirely software implementation or an implementation containing both hardware and software elements. In a preferred implementation, the specification is implemented in software, which includes, but is not limited to, firmware, resident software, microcode, etc.

Furthermore, the description can take the form of a computer program product accessible from a computer-usable or computer-readable medium providing program code for use by or in connection with a computer or any instruction execution system. For the purposes of this description, a computer-usable or computer-readable medium can be any apparatus that can contain, store, communicate, propagate, or transport the program for use by or in connection with the instruction execution system, apparatus, or device.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including, but not limited to, keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modems and Ethernet cards are just a few of the currently available types of network adapters.

Finally, the algorithms and displays presented herein are not inherently related to any particular computer or other apparatus. Various general-purpose systems may be used with programs in accordance with the teachings herein, or it may prove convenient to construct more specialized apparatus to perform the required method steps. The required structure for a variety of these systems will appear from the description below. In addition, the specification is not described with reference to any particular programming language. It will be appreciated that a variety of programming languages may be used to implement the teachings of the specification as described herein.

The foregoing description of the implementations of the specification has been presented for the purposes of illustration and description. It is not intended to be exhaustive or to limit the specification to the precise form disclosed. Many modifications and variations are possible in light of the above teachings. It is intended that the scope of the disclosure be limited not by this detailed description, but rather by the claims of this application. As will be understood by those familiar with the art, the specification may be embodied in other specific forms without departing from the spirit or essential characteristics thereof. Likewise, the particular naming and division of the modules, routines, features, attributes, methodologies and other aspects are not mandatory or significant, and the mechanisms that implement the specification or its features may have different names, divisions and/or formats. Furthermore, as will be apparent to one of ordinary skill in the relevant art, the modules, routines, features, attributes, methodologies and other aspects of the disclosure can be implemented as software, hardware, firmware or any combination of the three. Also, wherever a component, an example of which is a module, of the specification is implemented as software, the component can be implemented as a standalone program, as part of a larger program, as a plurality of separate programs, as a statically or dynamically linked library, as a loadable kernel module, as a device driver, and/or in every and any other way known now or in the future to those of ordinary skill in the art of computer programming. Additionally, the disclosure is in no way limited to implementation in any specific programming language, or for any specific operating system or environment. Accordingly, the disclosure is intended to be illustrative, but not limiting, of the scope of the specification, which is set forth in the following appended claims.

What is claimed is:

1. A computer-implemented method comprising:

receiving sensor data;

determining an application environment associated with an audio reproduction device based on the sensor data, wherein the audio reproduction device is associated with a user, wherein the application environment includes one or more deteriorating factors that deteriorate a sound quality of the audio reproduction device;

estimating a sound leakage caused by the one or more deteriorating factors;

determining one or more sound profiles based on the application environment and the sound leakage;

providing the one or more sound profiles to the user via a display of a user interface;

receiving a selection from the user interface of a first sound profile of the one or more sound profiles; and generating tuning data based on the first sound profile, the tuning data configured to sonically customize the audio reproduction device.

2. The method of claim 1, wherein the application environment is a physical environment surrounding the audio reproduction device.

3. The method of claim 1, wherein the application environment describes an activity status of the user associated with the audio reproduction device.

4. The method of claim 3, wherein the activity status includes one of running, walking, sitting, and sleeping.

5. The method of claim 1, wherein determining the application environment comprises:

receiving location data describing a location associated with the user; and determining the application environment based on the sensor data and the location data.

6. The method of claim 1, wherein the one or more sound profiles include at least one pre-programmed sound profile.

7. The method of claim 1, wherein determining the one or more sound profiles comprises:

monitoring audio content played in the audio reproduction device;

determining a genre associated with the audio content; and determining the one or more sound profiles further based on the genre associated with the audio content.

8. The method of claim 1, wherein determining the one or more sound profiles comprises:

determining a listening history associated with the user; and determining the one or more sound profiles further based on the listening history.

9. The method of claim 1, wherein determining the one or more sound profiles comprises:

receiving image data;

determining one or more deteriorating factors based on the image data;

estimating a sound degradation caused by the one or more deteriorating factors; and determining the one or more sound profiles further based on the estimated sound degradation.

10. The method of claim 1, wherein determining the one or more sound profiles comprises:

receiving data describing one or more user preferences; and determining the one or more sound profiles further based on the one or more user preferences.

11. The method of claim 1, wherein determining the one or more sound profiles comprises:

monitoring background noise in the application environment; and generating the one or more sound profiles that are configured to alleviate effect of the background noise.

12. The method of claim 1, wherein determining the one or more sound profiles comprises:

receiving device data describing the audio reproduction device; and determining the one or more sound profiles further based on the device data.

13. The method of claim 12, wherein the device data includes data describing a model of the audio reproduction device, and the one or more sound profiles include at least one pre-programmed sound profile configured for the model of the audio reproduction device.

14. The method of claim 1, wherein determining the one or more sound profiles comprises:

receiving data describing a target sound wave; and determining the one or more sound profiles that emulate the target sound wave.

15. The method of claim 1, wherein the tuning data includes the first sound profile and data configured to adjust a volume of the audio reproduction device.

16. A non-transitory computer program product comprising a non-transitory computer-usable medium including a computer-readable program, wherein the computer-readable program when executed on a computer causes the computer to:

receive sensor data;

determine an application environment associated with an audio reproduction device based on the sensor data, wherein the audio reproduction device is associated with a user, wherein the application environment includes one or more deteriorating factors that deteriorate a sound quality of the audio reproduction device;

estimate a sound leakage caused by the one or more deteriorating factors;

determine one or more sound profiles based on the application environment and the sound leakage;

provide the one or more sound profiles to the user via a display of a user interface;

receive a selection of a first sound profile from the one or more sound profiles via the user interface; and generate tuning data based on the first sound profile, the tuning data configured to sonically customize the audio reproduction device.

17. The non-transitory computer program product of claim 16, wherein determining the application environment comprises:

receiving sensor data;

receiving location data describing a location associated with the user; and determining the application environment based on the sensor data and the location data.

18. The non-transitory computer program product of claim 16, wherein determining the one or more sound profiles comprises:

monitoring audio content played in the audio reproduction device;

determining a genre associated with the audio content; and determining the one or more sound profiles further based on the genre associated with the audio content.

19. The non-transitory computer program product of claim 16, wherein determining the one or more sound profiles comprises:

determining a listening history associated with the user; and determining the one or more sound profiles further based on the listening history.

20. A system comprising:

a processor; and a memory storing instructions, when executed, cause the system to:

monitor audio content played on an audio reproduction device associated with a user;

determine a genre associated with the audio content;

determine an application environment associated with the audio reproduction device, the application environment indicating an activity status associated with the user;

determine one or more deteriorating factors that deteriorate a sound quality of the audio reproduction device;

estimate a sound leakage caused by the one or more deteriorating factors;

determine a sound profile based on the application environment and the genre associated with the audio content, the sound profile compensating for the sound leakage;

generate tuning data including the sound profile; and apply the tuning data in the audio reproduction device to sonically customize the audio reproduction device.

* * * * *